US009364067B2

(12) United States Patent
Pham

(10) Patent No.: US 9,364,067 B2
(45) Date of Patent: Jun. 14, 2016

(54) HAIR DYE APPLICATOR

(71) Applicant: Nghe Pham, Kenner, LA (US)

(72) Inventor: Nghe Pham, Kenner, LA (US)

( * ) Notice: Subject to any disclaimer, the term of this patent is extended or adjusted under 35 U.S.C. 154(b) by 55 days.

(21) Appl. No.: 14/478,848

(22) Filed: Sep. 5, 2014

(65) Prior Publication Data

US 2016/0066673 A1 Mar. 10, 2016

(51) Int. Cl.
*A45D 19/02* (2006.01)
*A46B 11/00* (2006.01)

(52) U.S. Cl.
CPC ..... *A45D 19/02* (2013.01); *A46B 11/0055* (2013.01)

(58) Field of Classification Search
CPC combination set(s) only.
See application file for complete search history.

(56) References Cited

U.S. PATENT DOCUMENTS 2,238,603 A * 4/1941 Runnels ..... A45D 24/16 119/612
5,109,553 A * 5/1992 Kishimoto ..... A46B 11/06 239/304
6,513,534 B1 * 2/2003 Sofer ..... A45D 24/28 132/112
7,427,169 B2 * 9/2008 Ma ..... A45D 19/02 132/113

* cited by examiner

*Primary Examiner* — David Walczak
(74) *Attorney, Agent, or Firm* — Gulf Coast Intellectual Property Group

(57) ABSTRACT

A hair dye applicator operable to assist a user in the application of hair dye to the hair on a human head. The hair dye applicator includes a body that has a handle portion and a brush assembly. The brush assembly includes a lower portion that has alternating rows of rigid comb bristles and brushes. The brush assembly further includes and upper portion having a hair dye assembly with an upper section and a lower section. The upper section and lower section of the hair dye assembly are operably coupled and form an interior volume configured to store hair dye therein. The upper section is movable with respect to the lower section wherein the downward vertical movement of the upper section facilitates the evacuation of hair dye from the interior volume. A piston coupled to the upper section is operable to move hair dye through a plurality of apertures.

14 Claims, 1 Drawing Sheet

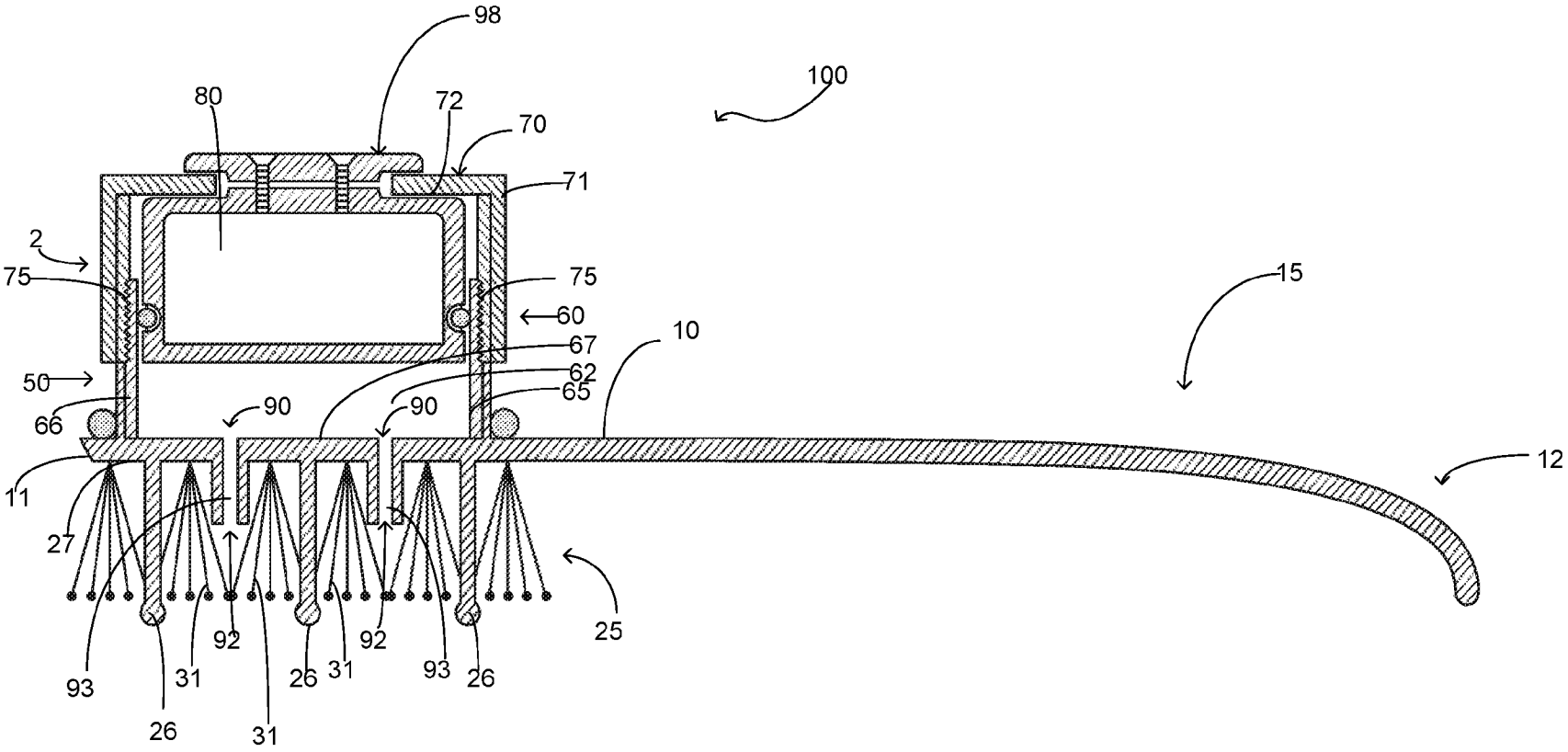
12
15
100
10
25
26
93
92
31
90
98
72
70
71
75
60
67
62
65
80
2
50
66
11
27

HAIR DYE APPLICATOR

PRIORITY UNDER 35 U.S.C SECTION 119(E) & 37 C.F.R. SECTION 1.78

This nonprovisional application claims priority based upon the following prior United States Provisional Patent Application entitled: Hair Dye Apparatus, Application No. 61/908,679 filed Nov. 25, 2013, in the name of Nghe Pham, which is hereby incorporated by reference for all purposes.

FIELD OF THE INVENTION

The present invention relates generally to hair salon tools, more specifically but not by way of limitation, a hair dye applicator that is operable to assist a cosmetologist apply a hair coloring dye to a user.

BACKGROUND

Millions of women and men have their hair colored on a regular basis. Whether it is to cover up graying hair or simply to change their color for cosmetic reasons, it is a routine procedure to color the hair of salon patrons. Hair coloring is known in the art and is accomplished using a single or a combinations of dyes that will change the patrons hair from a first color to a second color. The application of hair dye can range from a simple all over application to a complicated targeted application such as the process for applying a highlight of lighter color to the hair.

The application of hair dyes currently involves a few conventional tools. Cosmetologists typically utilize a plurality of foil sheets and a brush. A thin layer of the hair is separated by using a foil sheet and the cosmetologists utilizes a conventional brush to apply the hair coloring dye to the hair. This procedure requires significant dexterity and is quite time consuming.

Accordingly, there is a need for a hair dye applicator that can simplify the hair dye application process and further provide the ability to target a certain area of the hair.

SUMMARY OF THE INVENTION

It is the object of the present invention to provide a hair dye applicator that resembles a hairbrush wherein the hair dye applicator includes a hair dye reservoir.

Another object of the present invention is to provide a hair dye applicator operable to apply hair dye that includes a reservoir body that has a lower portion and an upper portion wherein the upper portion and lower portion are rotatably coupled.

A further object of the present invention is to provide a hair dye applicator that is operable to apply hair dye wherein the reservoir body further includes a piston.

Still another object of the present invention is to provide a hair dye applicator that is operable to assist a cosmetologist apply hair dye to a patron wherein the piston is operable to move from a first position to a second position in order to evacuate hair dye stored within the reservoir.

An additional object of the present invention is to provide a hair dye applicator that includes a head area underneath the reservoir wherein the head area includes a plurality of brushes and comb teeth.

Yet a further object of the present invention is to provide a hair dye applicator that includes a multitude of small diameter pipes that are operably connected to the reservoir and journal through the head area so as to direct hair dye into the brush zone.

Another object of the present invention is to provide a hair dye applicator that includes a handle integrally formed with the head area.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

FIG. 1 is a cross-sectional diagrammatic view of the present invention.

DETAILED DESCRIPTION

Referring now to the drawings submitted herewith, wherein various elements depicted therein are not necessarily drawn to scale and wherein through the views and FIGURES like elements are referenced with identical reference numerals, there is illustrated a hair dye applicator 100 constructed according to the principles of the present invention.

An embodiment of the present invention is discussed herein with reference to the FIGURES submitted herewith. Those skilled in the art will understand that the detailed description herein with respect to these FIGURES is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the hair dye applicator 100 includes a body 10 that is elongated in manner having a first end 11 and second end 12. The body 10 of the hair dye applicator 100 is constructed from a suitable durable material such as but not limited to plastic. The body 10 is similar to that of a handle and/or body of a conventional hairbrush that an individual would use to brush their hair. The body 10 includes handle portion 15 that is operable to provide sufficient surface area for a user to grasp the hair dye apparatus 100. It is contemplated within the scope of the present invention that the body 10 and handle 15 could be manufactured in various different lengths and suitable shapes.

Proximate the first end 11 is brush assembly 50. The brush assembly 50 includes a lower portion 25 and an upper portion 60. The lower portion 25 includes a plurality of comb bristles 26. The comb bristles 26 are secured to the lower surface 27 of the body 10 utilizing suitable durable techniques and extend downward therefrom. The comb bristles 26 are manufactured from a durable rigid material such as but not limited to plastic. FIG. 1 illustrated herein is a cross-sectional view, the hair dye apparatus 100 includes a plurality of comb bristles 26 extending downward from the body 10 across substantially most of the lower surface area 27 of the brush assembly 50. Dispersed among the comb bristles 26 are brushes 31. Brushes 31 are secured to the lower surface 27 of the body 10 utilizing suitable durable techniques and extend downward therefrom. The brushes 31 are manufactured from a flexible material such as but not limited to nylon. The brushes 31 are operable to apply the hair dye disposed within the interior volume 62 as further discussed herein As a user engages the hair of client during use of the hair dye applicator 100, the comb bristles 26 function to orient the hair strands in the same direction while the brushes 31 distribute hair dye onto the hair strands. The brushes 31 are mounted in rows intermediate and amongst the rows of comb bristles 26.

The upper portion 60 of the brush assembly 50 comprises a hair dye dispenser 2 including a bottom portion 65 and top portion 70. The bottom portion 65 and top portion 70 are movably secured so as to facilitate the rotatable and vertical movement of the top portion 70 in relation to the bottom portion 65. The rotatable and vertical movement of the top portion 70 is accomplished with threads 75. It is contemplated within the scope of the present invention that the rotatable and vertical movement of the top portion 70 could be achieved using various mounting techniques. The bottom portion 65 includes outer wall 66, which in combination with bottom 67 is operable to define interior volume 62. The interior volume 62 functions to store hair dye that is to be applied to hair.

Top portion 70 includes wall 71 and top 72 manufactured from a suitable durable material. Secured to the top 72 is piston 80. Piston 80 is manufactured from a suitable durable material such as but not limited to plastic. The piston 80 is sealably secured against outer wall 66 and functions to apply a downward force on any hair dye disposed within the interior volume 62 as the top portion 70 is moved downward in relation to bottom portion 65. A user will rotate the top portion 70 in a clockwise direction so as to move the top portion 70 in a vertically downward direction. As the top portion 70 traverses vertically downward the volume of the interior volume 62 is diminished by piston 80 traversing downward thereinto. This movement causes hair dye disposed within the interior volume 62 to be forced out apertures 90. Apertures 90 are fluidly coupled with discharge tubes 92. Hair dye disposed within the interior volume 62 egresses outward apertures 90 and through discharges tubes 92. The discharge tubes 92 include hollow passage 93 and are positioned proximate brushes 31 so as to ensure a desired even distribution of hair dye onto the brushes 31 which apply the hair dye to the strands of hair engaged with the hair dye applicator 100. It is contemplated within the scope of the present invention that the brush assembly 50 could have numerous different quantities of apertures 90 and discharge tubes 92.

Top portion 70 as previously mentioned herein is rotatably mounted to bottom portion 65 using threads 75. Top portion 70 is mounted so as to facilitate its complete removal from bottom portion 65. This enables access to interior volume 62 in order to place a desired amount of hair dye therein. Top portion 70 further includes dial 98 that can be used to facilitate engagement of top portion 70.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A hair dye applicator comprising:

a body, said body being elongated in manner having a first end and a second end, said body including a handle portion proximate said second end;

a brush assembly, said brush assembly being proximate said first end of said body, said brush assembly including a plurality of comb bristles extending downward therefrom, said brush assembly further including a plurality of brushes extending downward therefrom, said brush assembly including an upper portion, said upper portion opposite said body from said plurality of comb bristles and said plurality of brushes, said upper portion having a top section and a bottom section, said top section and said bottom section being operably secured to each other, said top section and said bottom section defining an interior volume, said interior volume operable to receive and store hair dye;

a plurality of apertures, said plurality of apertures being journaled through said body within the bottom section into the interior volume;

a plurality of discharge tubes, said discharge tubes operably connected to said plurality of apertures, said discharge tubes having a first end and a second end;

a piston, said piston being operably coupled to said top section, said piston operable to facilitate the evacuation of hair dye disposed within the interior volume of the during downward movement of said top section, said piston having a first position and a second position; and wherein said hair dye apparatus is operable to distribute hair dye on hair of a human head as the piston is moved from its first position to its second position.

2. The hair dye applicator as recited in claim 1, wherein said second end of said discharge tubes are proximate said plurality of brushes.

3. The hair dye applicator as recited in claim 2, wherein said top section is configured to be removable from said bottom section so as to provide access to the interior volume for deposit of hair dye therein.

4. The hair dye applicator as recited in claim 3, wherein said top section is rotatably secured to said bottom section utilizing threads so as to facilitate the transitioning of the top section from its first position to its second position for enabling hair dye to be evacuated from said interior volume through said plurality of apertures into said plurality of discharge tubes.

5. The hair dye applicator as recited in claim 4, wherein said plurality of comb bristles and said plurality of brushes are oriented in alternating rows.

6. A hair dye applicator operable to assist an individual in the application of a hair dye to hair on a human head comprising:

a body, said body being elongated in manner having a first end and a second end, said body having an upper surface and a lower surface, said body including a handle portion proximate said second end;

a brush assembly, said brush assembly having an upper portion and a lower portion, said lower portion of said brush assembly further including comb bristles oriented in rows extending downward from said lower surface of said body, said lower portion of said brush assembly having a plurality of rows of brushes intermediate the rows of comb bristles;

a piston, said piston being operably secured to said upper section of said hair dye dispenser, said piston having a sealable connection with said lower section of said hair dye dispenser;

a plurality of apertures, said plurality of apertures being journaled through said body into the interior volume of said hair dye assembly;

a plurality of discharge tubes, said discharge tubes having a hollow passage so as to facilitate hair dye transfer to said plurality of rows of brushes; and wherein said upper portion of said brush assembly includes a hair dye dispenser, said hair dye dispenser having an upper section and a lower section, said upper section being vertically movable with respect to said lower section, said upper section and said lower section being operably coupled to create an interior volume, said interior volume operable to receive a hair dye therein, said upper section having a first position and a second position wherein during transition from said first position to said second position said hair dye dispenser is operable to deposit hair dye onto said plurality of rows of brushes.

7. The hair dye applicator as recited in claim 6, wherein said upper section of the hair dye assembly is rotatably secured to said lower section of the hair dye assembly.

8. The hair dye applicator as recited in claim 7, wherein said upper section of the hair dye assembly is configured to be removable from said lower section so as to facilitate access to the interior volume.

9. The hair dye applicator as recited in claim 8, wherein said upper section of said hair dye assembly further includes dial, said dial superposed the upper section.

10. A hair dye applicator operable to provide application of hair dye to hair on a human head comprising:

a body, said body being elongated in manner having a first end and a second end, said body having an upper surface and a lower surface, said body including a handle portion proximate said second end;

a brush assembly, said brush assembly having an upper portion and a lower portion, said lower portion of said brush assembly further including comb bristles oriented in rows extending downward from said lower surface of said body, said lower portion of said brush assembly having a plurality of rows of brushes intermediate the rows of comb bristles;

wherein said upper portion of said brush assembly includes a hair dye dispenser, said hair dye dispenser having an upper section and a lower section, said upper section being vertically movable with respect to said lower section, said upper section and said lower section being operably coupled to create an interior volume, said interior volume operable to receive a hair dye therein, said upper section having a first position and a second position wherein during transition from said first position to said second position said hair dye dispenser is operable to deposit hair dye onto said plurality of rows of brushes;

a plurality of apertures, said plurality of apertures being journaled through said body into the interior volume of said hair dye dispenser, and further including a plurality of discharge tubes, said discharge tubes having a hollow passage so as to facilitate hair dye transfer to said plurality of rows of brushes; and a piston, said piston being operably secured to said upper section of said hair dye dispenser, said piston having a sealable connection with said lower section of said hair dye dispenser.

11. The hair dye applicator as recited in claim 10, wherein said upper section of the hair dye assembly is rotatably secured to said lower section of the hair dye assembly.

12. The hair dye applicator as recited in claim 11, wherein said upper section of the hair dye assembly is configured to be removable from said lower section so as to facilitate access to the interior volume.

13. The hair dye applicator as recited in claim 12, wherein said brushes are manufactured from nylon.

14. The hair dye applicator as recited in claim 13, wherein said upper section of said hair dye assembly dispenser includes dial, said dial superposed the upper section, said dial operable to provide an interface to rotatably move said upper section.

* * * * *